US008807568B1

(12) United States Patent
Ruder

(10) Patent No.: US 8,807,568 B1
(45) Date of Patent: Aug. 19, 2014

(54) BALL GAME

(71) Applicant: Christofer Joseph Ruder, Chicago, IL (US)

(72) Inventor: Christofer Joseph Ruder, Chicago, IL (US)

(73) Assignee: Kankakee Spikeball, Inc., Chicago, IL (US)

( * ) Notice: Subject to any disclaimer, the term of this patent is extended or adjusted under 35 U.S.C. 154(b) by 23 days.

(21) Appl. No.: 13/850,592

(22) Filed: Mar. 26, 2013

(51) Int. Cl.
*A63B 67/00* (2006.01)
*A63B 71/00* (2006.01)
*A63B 71/02* (2006.01)

(52) U.S. Cl.
CPC ..... *A63B 67/002* (2013.01)
USPC ..... 273/342

(58) Field of Classification Search
USPC ..... 273/317, 342
See application file for complete search history.

(56) References Cited

U.S. PATENT DOCUMENTS

| | | | | | |
|---|---|---|---|---|---|
| 2,275,179 | A * | 3/1942 | Heil | ..... | 473/475 |
| 3,368,814 | A * | 2/1968 | Kolwicz | ..... | 273/342 |
| 5,016,891 | A * | 5/1991 | Nelson | ..... | 273/407 |
| 5,201,526 | A * | 4/1993 | Ketcham, Jr. | ..... | 273/342 |
| 5,566,948 | A * | 10/1996 | Kidd | ..... | 273/342 |
| 8,002,282 | B1 * | 8/2011 | Koski | ..... | 273/342 |

* cited by examiner

*Primary Examiner* — Raleigh W Chiu
(74) *Attorney, Agent, or Firm* — Justin Lampel

(57) ABSTRACT

A ball game is provided. The ball game has a generally flat surface which allows balls to bounce. The generally flat surface largely resembles a trampoline. In use, the generally flat surface is substantially parallel with respect to the ground. A user stands on solid ground outside a perimeter of the generally flat surface and bounces the ball off the generally flat surface. The height and tension of the generally flat surface may be easily adjusted.

9 Claims, 5 Drawing Sheets

BALL GAME

CROSS REFERENCE TO RELATED APPLICATIONS

The present application is based on U.S. provisional application No. 61/615,383 filed on Mar. 26, 2012, the entire contents of which are incorporated by reference. Applicant claims the priority benefit of the 61/615,383 application.

BACKGROUND OF THE INVENTION

A ball game is provided. The ball game has a generally flat surface which allows balls to bounce. The generally flat surface largely resembles a trampoline. In use, the generally flat surface is substantially parallel with respect to the ground. A user stands on solid ground outside a perimeter of the generally flat surface and bounces the ball off the generally flat surface. The height and tension of the generally flat surface may be easily adjusted.

Over the years numerous games have been invented which incorporate a flexible surface or trampoline used to play a ball game. For example, U.S. Pat. No. 7,611,427 to Cline discloses a system, and apparatus provide multiple players with a unique competitive game. According to one implementation described herein, a game partition has opposing side edges, a top edge, and a bottom edge. Transparent or translucent partition material spans the area defined by these edges and includes at least one aperture sized to allow a game ball to pass through. The game partition may include numerous apertures of various shapes and sizes. The game partition may be utilized in conjunction with a trampoline or inflatable jumping device to provide teams of players to attempt to tag opposing players with balls thrown through the apertures in the game partition while maneuvering on the jumping surface. According to one implementation, points are scored and accumulated according to point values assigned to each aperture when a ball is thrown through an aperture and tags an opposing player.

Further, U.S. Pat. No. 6,676,546 to Gordon discloses court and method for playing a game. The game court comprises a playing surface suitably large for running and jumping players, having adjacent surface areas with distinctly different properties. A first area of the playing surface is substantially rigid and resilient, and suitable for bouncing a ball. Optionally, the first area of playing surface comprises a resiliently suspended floor. The second area is a deformable-elastic surface, such as a trampoline surface, that is tuned to greatly increase the heights that players may attain by jumping. The game court is optionally surrounded by a wall comprising at least a portion of the court boundary. A game for playing on the game court is disclosed, comprising a basketball-like game. The game court may also be used for other sports such as gymnastics or exhibition-style wrestling.

However, these games fail to provide a ball game having the features described below wherein a user bounces a ball off a trampoline surface and when the user remains on solid ground.

SUMMARY OF THE INVENTION

A ball game is provided. The ball game has a generally flat surface which allows balls to bounce. The generally flat surface largely resembles a trampoline. In use, the generally flat surface is substantially parallel with respect to the ground. A user stands on solid ground outside a perimeter of the generally flat surface and bounces the ball off the generally flat surface. The height and tension of the generally flat surface may be easily adjusted.

An advantage of the present device is to provide a ball game wherein a player may stand on solid ground and may bounce a ball off a trampoline-like surface toward another player and wherein the other player must return the ball.

Yet another advantage of the present device is to provide a ball game which is light-weight and easy to transport.

And another advantage of the present device is to provide a ball game which can easily be assembled or dissembled.

Still another advantage of the present device is to provide a ball game which can be easily adjusted for tension by the player.

Another advantage of the present device is to provide a ball game which is inexpensive to produce and fun to play.

For a more complete understanding of the above listed features and advantages of the present ball game, reference should be made to the following detailed description of the preferred embodiments. Further, additional features and advantages of the invention are described in, and will be apparent from, the detailed description of the preferred embodiments.

BRIEF DESCRIPTION OF THE DRAWINGS

FIG. 6 illustrates a front plan view of the bag in which the game is stored in.

DETAILED DESCRIPTION OF THE PREFERRED EMBODIMENTS

A ball game is provided. The ball game has a generally flat surface which allows balls to bounce. The generally flat surface largely resembles a trampoline. In use, the generally flat surface is substantially parallel with respect to the ground. A user stands on solid ground outside a perimeter of the generally flat surface and bounces the ball off the generally flat surface. The height and tension of the generally flat surface may be easily adjusted.

Figure 1:
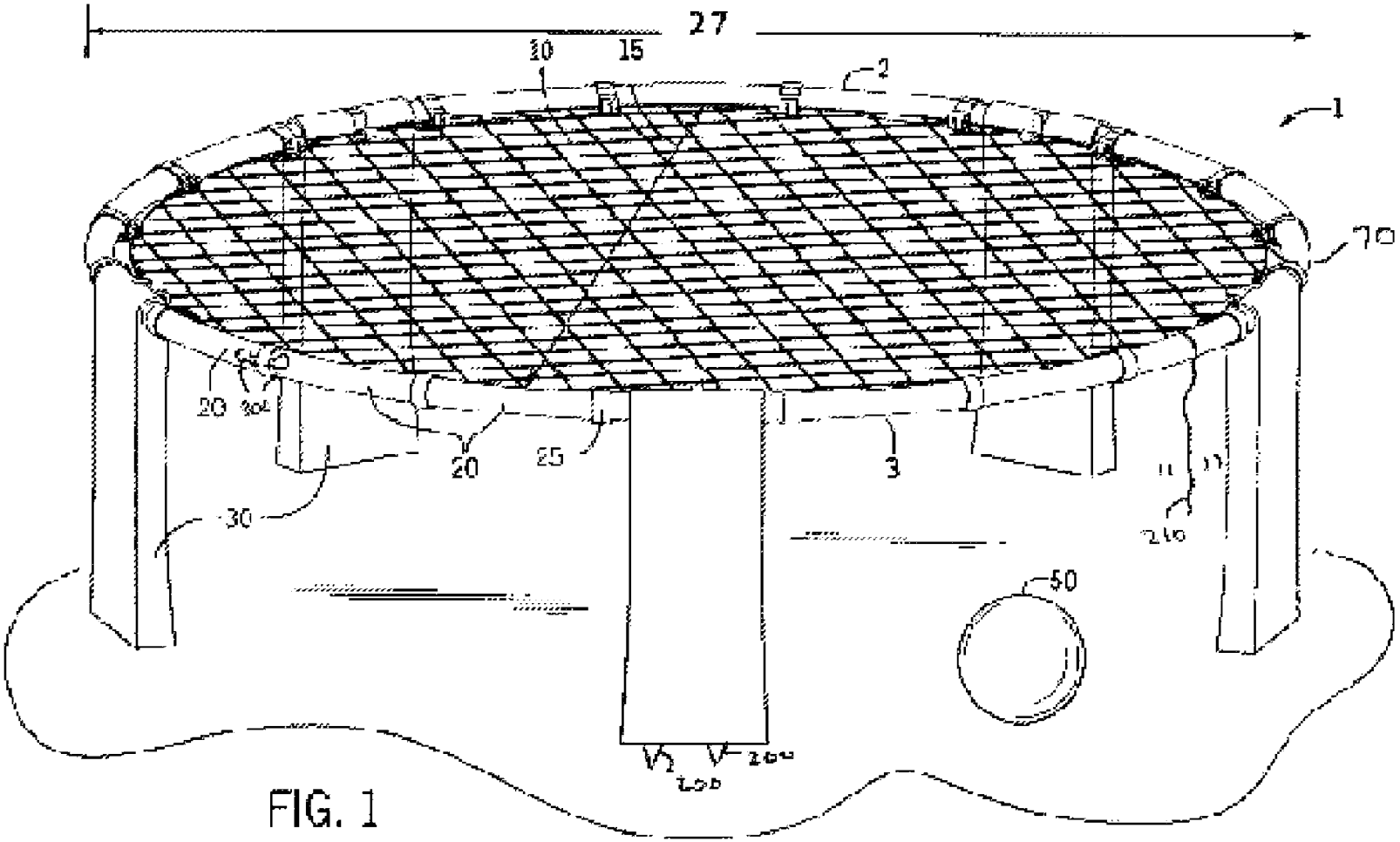
FIG. 1 illustrates a front perspective view of the game with a ball.

Referring now to FIG. 1, a ball game 1 is provided. The game 1 may have a top side 2 and a bottom side 3. The game 1 may have a generally flat playing surface 10, a plurality of perimeter base supports 20, a plurality of legs 30 and a ball 50.

Figure 6:
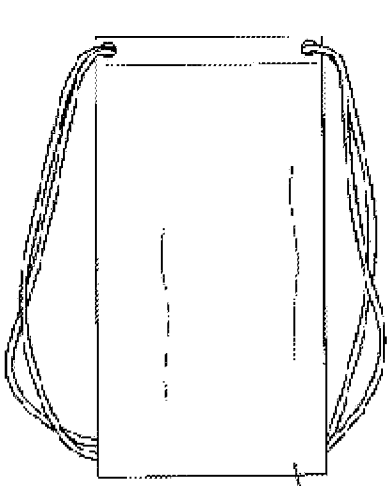
Figure 3:
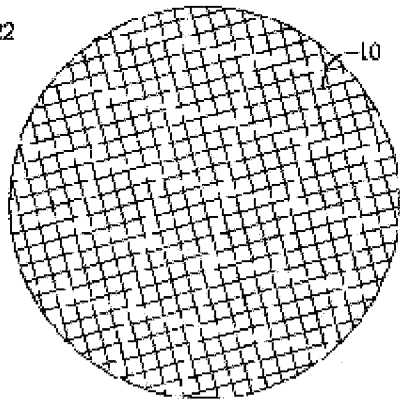
FIG. 3 illustrates a top plan view of the playing surface of the game.
Figure 2:
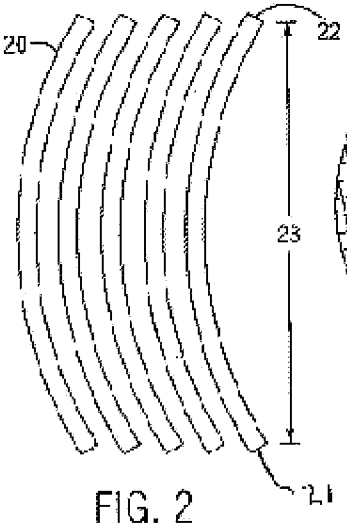
FIG. 2 illustrates a top plan view of the perimeter brace supports of the game.
Figure 5:
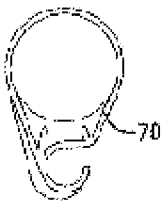
FIG. 5 illustrates a side plan view of the clamp of the game.
Figure 4:
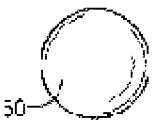
FIG. 4 illustrates a front plan view of the ball of the game.

In an embodiment, the game 1 may neatly be disassembled and transported in a carrying bag 60 (FIG. 6).

In an embodiment, the playing surface 10 of the game 1 is circular. The playing surface 10 is preferably made from an elastic material such as, for example, elastic netting (as shown in the drawings) or an elastic bounce matt. The playing surface 10 may have a diameter 15.

The plurality of perimeter base supports 20 may have a first end 21, a second end 22, a length 23 and may be generally cylindrical and arch shaped. The first end 21 of a first of the plurality of perimeter base supports 20 may connect to a second end 22 of a second of the plurality of perimeter base supports 20. More specifically, the first perimeter base support 20 may connect to the second perimeter base support 20 at a connector 25. The connector 25 may be arch-shaped cylindrical tubing which has a greater circumference than the circumference of the perimeter base supports 20 such that the ends 21, 22 of the perimeter base supports 20 fits snugly into the connector 25. The ends 21, 22 of the perimeter base supports 20 may be secured within the connectors 25 by, for example, friction. In an embodiment, the connector 25 does not have a hook to grasp a portion of the generally circular playing surface 10.

Although any number of perimeter base support 20 members may be used, the number of perimeter base supports 20 and the degree of the arch of the same should result in a circular base support all the way around the circular playing surface 10 when properly assembled. Further, a diameter 27 created by the connection of all the perimeter base support 20 members should be slightly greater than the diameter 15 of the circular playing surface 10 such that the circular playing surface 10, when fully extended, fits within the diameter 27 of the perimeter base supports 20.

Figure 7:
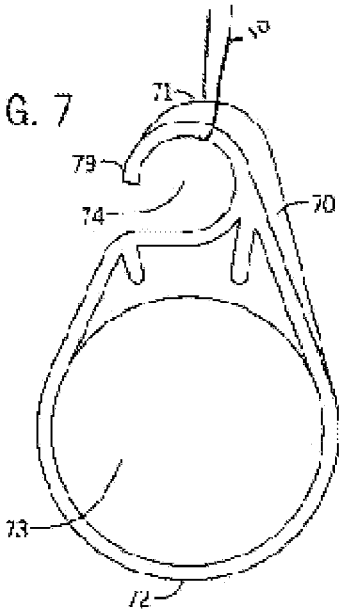
FIG. 7 illustrates a side plan view of the clamp of the game wherein a single-hook is provided.
Figure 8:
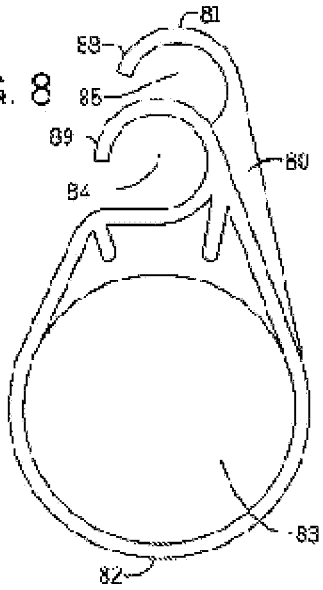
FIG. 8 illustrates a side plan view of the clamp of the game wherein a double-hook is provided.

Referring now to FIGS. 7 and 8, a plurality of clamps 70, 80 may be used to secure the circular playing surface 10 to the plurality of perimeter base support members 20. In an embodiment, the plurality of clamps 70, 80 also performs the function of the connector 25 wherein the plurality of clamps 70, 80 secure not only grasp a portion of the circular playing surface 10 but also secures two of the base support members 20 to each other.

FIG. 7 illustrates a clamp 70 having a single-hook embodiment whereas FIG. 8 illustrates a clamp 80 having a double-hook embodiment. The clamps 70, 80 may have a first end 71, 81 and a second end 72, 82. The clamps 70, 80 may further have a large generally circular opening 73, 83 wherein a portion of the plurality of perimeter base portions 20 are inserted through. More specifically, to set up the game 1, the user insert the first end 21 or second end 22 of the plurality of perimeter base portions 20 through the openings 73, 83 of the clamps 70, 80. In an embodiment wherein clamps 70, 80 and connectors 25 are both used, the user first inserts the clamps 70, 80 over the plurality of perimeter base portions 20 and then secures the perimeter base portions 20 to the connectors 25 forming a complete circle. In this embodiment, the clamps 70, 80 are located between two of the connectors 25. In the embodiment wherein the clamps 70, 80 also perform the function of the connectors 25, nothing is secured to the perimeter base portions 20 between two of the clamps 70, 80.

The first clamp 70 may have a circular, but not non-complete opening 74 near the first end 71. The circular, but not non-complete opening 74 may be used to grasps and secure a portion of the circular playing surface 10 to the plurality of perimeter base portions 20. As a result, the circular playing surface 10 may be secured by using numerous clamps 70 around the perimeter base portions 20. When in use, the circular playing surface 10 remains tightly stretched, but still flexible. Further, when in use the circular playing surface 10 remains largely parallel with respect to the ground.

The second clamps 80 may be used instead of the first clamps 70. The second clamps 80 may have a first opening 85 and a second opening 84 which operate in a similar fashion as the opening 74 of the first clamp 70. However, the second clamp 80 may allow a user to adjust the tension on the circular playing surface 10 so as to better control the action on the game. More specifically, if the user desires the circular playing surface 10 to have more tension, the user will select the second opening 84; the opening farther away from the center of the circular playing surface 10. If the user desires to have less tension, the user will elect the first opening 85; the opening closer to the circular playing surface 10.

Referring now to FIGS. 11-14, a plurality of legs 30 may be used to elevate and support the circular playing surface 10. Although the drawings show five legs 30, any number of legs 30 may be used. The plurality of legs 30 may have a first end 160 and a second end 170. The first end 160 may be secured to the plurality of perimeter base portions 20 whereas the second end 170 may rest upon the ground. The plurality of legs 30 may have an opening 180 wherein the plurality of perimeter base portions 20 is inserted through in a similar fashion as the clamps 70, 80. In an embodiment, the plurality of legs 30 may have a single hook portion 121 or a double hook portion 120 which may be used to grasp a portion of the circular playing surface 10 in a manner similar to that of the first clamp 70 or second clamp 80. As a result, the device 1 may have increased durability and stability from use of the clamps 70, 80 in addition to use of the hooks 120, 121 of the legs 30 to secure the circular playing surface 10.

To play the game a user assembles the game 1 by attaching the plurality of legs 30, the plurality of clamps 70 or 80, the circular playing surface 10, the plurality of perimeter base portions 20, and lastly the connectors 25 (in the embodiment with both connectors 25 and clamps 70, 80). Once proper tension is achieved, the ball 50 is bounced off the circular playing surface 10 and an opposing play must return bounce the ball. Official or house rules may be used.

In an alternative embodiment, a spike 200 may be located at the second end 170 of the plurality of legs 30 wherein the spikes 200 may be driven into the ground (or sand) and may help reduce the chances of the device 1 shifting during play.

Figure 9:
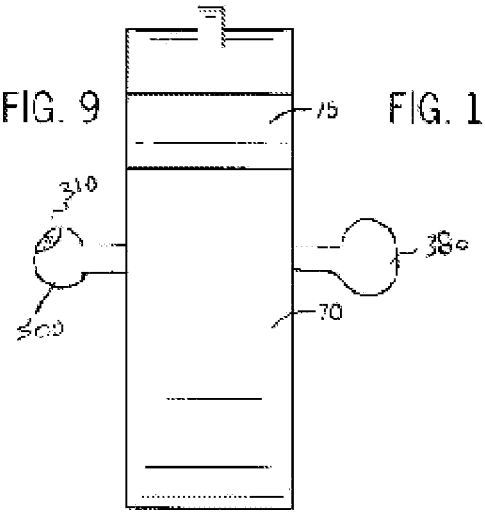
FIG. 9 illustrates a front plan view of the clamp of the game wherein a single-hook is provided.
Figure 10:
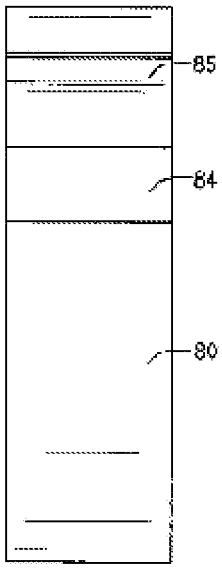
FIG. 10 illustrates a front plan view of the clamp of the game wherein a double-hook is provided.
Figure 12:
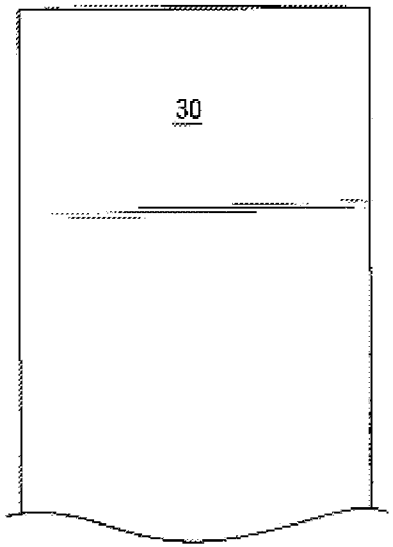
FIG. 12 illustrates a front plan view of a leg of the game.
Figure 11:
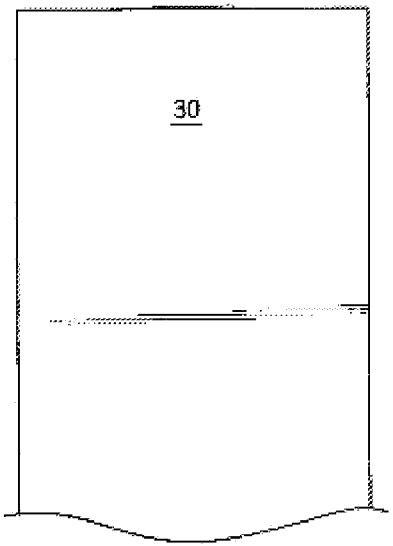
FIG. 11 illustrates a front plan view of a leg of the game.
Figure 13:
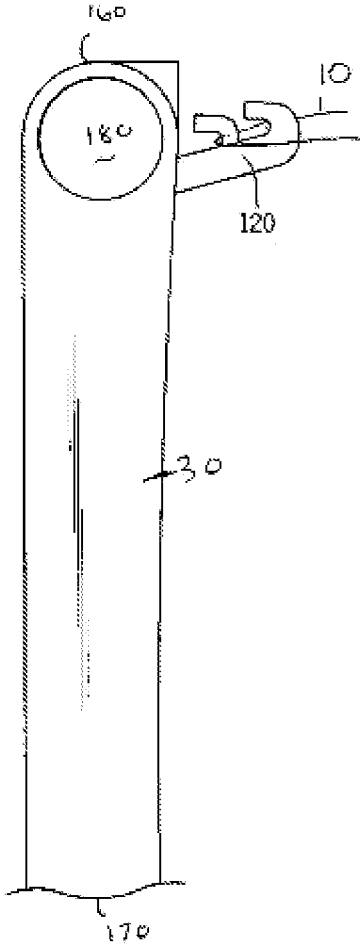
FIG. 13 illustrates a side plan view of a leg of the game wherein a double-hook is provided.
Figure 14:
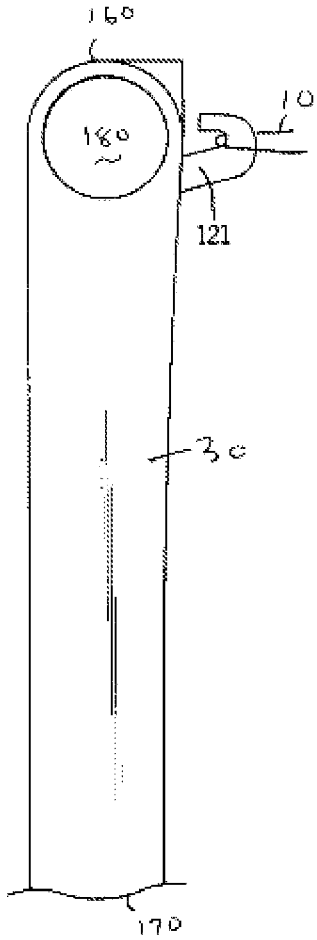
FIG. 14 illustrates a side plan view of a leg of the game wherein single-hook is provided.

Referring now to FIG. 9, in an embodiment, the plurality of clamps 70, 80 may each have a generally flat first extension 300 and a generally flat second extension 380. The first extension 300 an second extension 380 may be generally flexible and may have an adhesive element 310 located on one side (the side facing the base portion 20) wherein the adhesive element 310 of the first extension 300 and second extension 380 allow the plurality of clamps 70, 80 to be further secured to the plurality of perimeter base portions 20 and therein reducing the chances of the plurality of perimeter base portions 20 from becoming accidentally dislodged from the clamps 70, 80.

Finally, in an embodiment, a lightweight string 210 is secured to at least one of the perimeter base portions 20. The light-weight string 210 moves freely in the wind and allows a user to determine the approximate wind speed and direction so as to better judge how to strike the ball 50. In an embodiment, the light-weight string 210 is reflective so as to be better seen in low lighting.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A ball game comprising:

a generally circular playing surface wherein the generally circular playing surface is elastic and elevated above the ground;

a ball for bouncing off the generally circular playing surface;

a plurality of leg supports wherein the plurality of leg supports have a first end and a second end and wherein the first end is located near the generally circular playing surface and wherein the second end rests on the ground;

a plurality of generally arched-shaped tubing units wherein the plurality of generally arched-shaped tubing units, when assembled, form a circle which surrounds the generally circular playing surface; and a plurality of securing clamps having a length wherein the plurality of securing clamps have a hook portion which grasps a portion of the generally circular playing surface and a circular opening wherein the circular opening of the plurality of securing clamps receives a portion of at least one of the generally arched-shaped tubing units.

2. The ball game of claim 1 wherein the tubing units are secured to the plurality of clamps units by friction.

3. The ball game of claim 1 wherein the length of the plurality of clamps are arched-shaped.

4. The ball game of claim 1 wherein the plurality of securing clamps have a first hook portion and a second hook portion wherein the first hook portion is located closer to a center of the generally circular playing surface than the second hook portion; and wherein a greater tension on the generally circular playing surface is created by electively securing the generally circular playing surface to the second hook portion of the clamp than the tension created by electively securing the generally circular playing surface to the first hook portion of the clamp and wherein the greater tension effects the movement of the ball when the ball strikes the generally circular playing surface.

5. The ball game of claim 1 further comprising:

a hook portion located at the first end of the plurality of legs wherein the hook portion of the plurality of legs faces the generally circular playing surface and wherein the hook portion of the plurality of legs secures a portion of the generally circular playing surface.

6. The ball game of claim 1 wherein the plurality of clamps secures two of the plurality of generally arched-shaped tubing units together.

7. The ball game of claim 1 further comprising:

a spike located under the second end of the plurality of legs wherein the spike is driven into the ground and reduces the shifting of the plurality of legs during use.

8. The ball game of claim 1 further comprising:

a string secured to one of the generally arched-shaped tubing units wherein the movement of the string in the wind allows a user to determine wind speed and direction.

9. A ball game comprising:

a generally circular playing surface wherein the generally circular playing surface is elastic and elevated above the ground;

a ball for bouncing off the generally circular playing surface;

a plurality of leg supports wherein the plurality of leg supports have a first end and a second end and wherein the first end is located near the generally circular playing surface and wherein the second end rests on the ground;

a plurality of generally arched-shaped tubing units wherein the plurality of generally arched-shaped tubing units, when assembled, form a circle which surrounds the generally circular playing surface;

a plurality of securing clamps wherein the plurality of securing clamps have a hook portion which grasps a portion of the generally circular playing surface and an opening wherein the opening of the plurality of securing clamps receives one of the generally arched-shaped tubing units; and a plurality of connecter units wherein the plurality of connector units receive and connect two of the plurality of tubing units.

* * * * *